US009371494B2

(12) United States Patent
Oyekan et al.

(10) Patent No.: US 9,371,494 B2
(45) **Date of Patent: *Jun. 21, 2016**

(54) MIXED ADDITIVES LOW COKE REFORMING

(71) Applicant: Marathon Petroleum Company LP, Findlay, OH (US)

(72) Inventors: Soni O. Oyekan, LaPlace, LA (US); Michael G. Robicheaux, Montz, LA (US)

(73) Assignee: Marathon Petroleum Company LP, Findlay, OH (US)

( * ) Notice: Subject to any disclaimer, the term of this patent is extended or adjusted under 35 U.S.C. 154(b) by 299 days.

This patent is subject to a terminal disclaimer.

(21) Appl. No.: 13/682,218

(22) Filed: Nov. 20, 2012

(65) Prior Publication Data

US 2014/0138282 A1 May 22, 2014

(51) Int. Cl.
*C10G 35/00* (2006.01)
*C10G 35/04* (2006.01)

(52) U.S. Cl.
CPC ..... *C10G 35/04* (2013.01)

(58) Field of Classification Search
USPC ..... 208/107–108, 113, 133–134
See application file for complete search history.

(56) References Cited

U.S. PATENT DOCUMENTS

| | | | | |
|---|---|---|---|---|
| 4,332,671 | A | 6/1982 | Boyer | |
| 4,741,819 | A * | 5/1988 | Robinson et al. | 208/65 |
| 5,045,177 | A | 9/1991 | Cooper et al. | |
| 5,053,371 | A | 10/1991 | Williamson | |
| 5,885,439 | A | 3/1999 | Glover | |
| 5,935,415 | A | 8/1999 | Haizmann et al. | |
| 7,419,583 | B2 | 9/2008 | Nieskens et al. | |
| 7,637,970 | B1 | 12/2009 | Fox et al. | |
| 7,988,753 | B1 | 8/2011 | Fox et al. | |
| 2004/0251170 | A1 * | 12/2004 | Chiyoda et al. | 208/244 |
| 2011/0147267 | A1 | 6/2011 | Kaul et al. | |
| 2012/0125814 | A1 * | 5/2012 | Sanchez et al. | 208/64 |

OTHER PUBLICATIONS

Martino, G. (2001). Petroleum Refining Conversion Processes, vol. 3, edited by P. Leprince, Technip, 670 pgs [Office action cites Table 4.13 & Figure 4.47].*

* cited by examiner

*Primary Examiner* — Brian McCaig
(74) *Attorney, Agent, or Firm* — Emch, Schaffer, Schaub & Porcello Co., L.P.A.

(57) ABSTRACT

Optimizing low coke naphtha reforming continues to pose significant challenges for oil refining companies in the operation of continuous catalytic regenerative reforming units for economic production of hydrogen, LPG and reformate. A novel processing scheme is hereby disclosed wherein multiple additives are used to increase spent catalyst coke to ensure operating the regenerators in steady state white burn operations. In previous disclosures novel additives sulfur and kerosene were identified as separately imparting enhanced rates of coke formation on the catalysts even at very mild severity catalytic reforming operations. To further accelerate spent catalyst coke formation and derive benefits from synergistic use of sulfur and kerosene, it is suggested that both sulfur and kerosene be used as additives in combination or in series with sulfur added first followed by kerosene and vice versa.

7 Claims, 1 Drawing Sheet

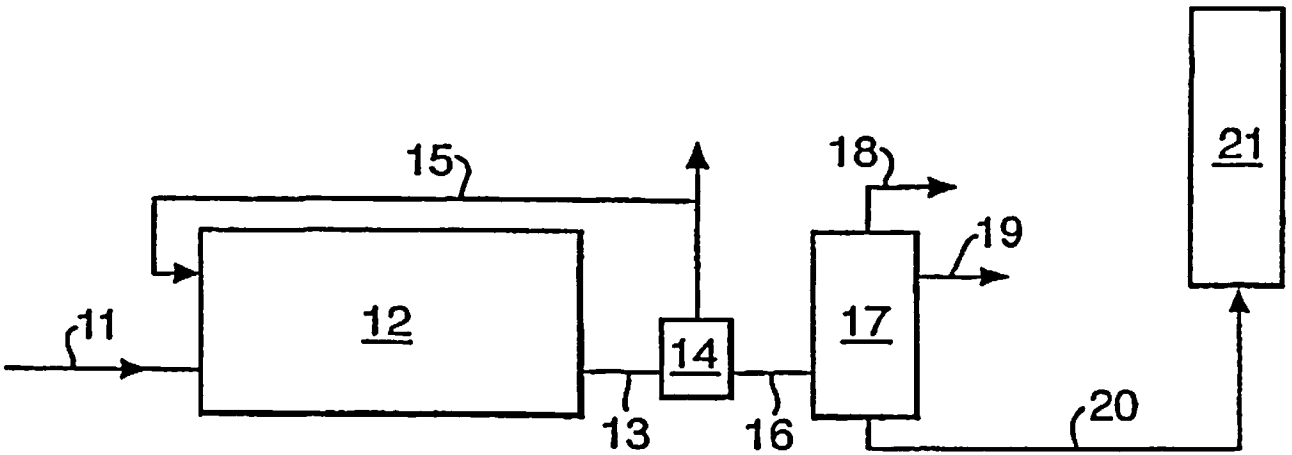
11
12
13
14
15
16
17
18
19
20
21

MIXED ADDITIVES LOW COKE REFORMING

BACKGROUND OF THE INVENTION

Continuous catalyst regeneration (CCR) naphtha processes are designed to operate at high severity conditions of low pressure, low hydrogen to hydrocarbon ratio and produce high octane reformates for gasoline blending. The desired operating range to sustain steady state white burn regenerator operations for good unit productivity requires that the process generates catalyst coke in a range of 3.0 to 7.0 wt % on the catalyst. Recent environmental regulations have led to a need to operate and produce low octane reformates due to substantial ethanol blending. Over the past years, the concentration of ethanol in the gasoline blend has been 10 vol. %. Recently an increase to 15 vol. % was proposed for cars manufactured after 2007.

In addition and more recently, the price differential between diesel and gasoline has favored more production of diesel and has led to deeper cuts in the naphtha fraction for feed to distillate desulfurization units. The removal of higher boiling naphtha compounds has resulted in low endpoint naphtha feeds for the reformers and these naphtha feeds make much lower spent catalyst coke.

Furthermore, due to the need to minimize expensive gasoline octane give away, refiners are now operating their CCR reformers at low severities that is for the production of lower reformate octanes which lead to catalyst coke production rates that are much lower than desired spent catalyst cokes that are much less than 3 wt. %. Due to concerns with low catalyst flow and sustaining steady state coke burns in regenerators, refiners are opting to shutting down their regenerators for long periods of time in order not to damage equipment such air heaters, disengaging hopper and the regenerator screens. The frequent regenerator outages lead to inadequate catalyst reactivations and, hence, to poor catalyst performance, low unit productivity, uneconomical reformer operations and reliability problems.

SUMMARY OF THE INVENTION

The invention involves the use of specifically selected coke precursor compounds from the front end of oil distillate fractions that preferably contain kerosene and sulfur and their use as additives in the processing of naphtha in a catalytic reformer. The use of a sulfur kerosene compound additives enhance coke make in continuous catalyst regeneration (CCR) reformers to levels higher than those which are usually produced in low coke naphtha reforming operations.

With the increase in ethanol blending in gasoline, naphtha processing in reformers is conducted at lower octane severities. In the low octane severities operations, reformers do not produce the necessary amount of coke to permit sustaining steady state white burn operations required to maintain platformer productivity and profitability. The use of this invention permits operating performers more productively and profitably by adding appropriately selected coke precursor compounds to permit generating sufficient catalyst coke for steady state continuous regenerator operations required for optimal reactivation of the catalyst.

Other objects and advantages of the present invention will become apparent to those skilled in the art upon a review of the following detailed description of the preferred embodiments and the accompanying drawings.

IN THE DRAWINGS

FIG. 1 shows a conventional CCR reforming unit.

DETAILED DESCRIPTION OF THE INVENTION

FIG. 1 shows a conventional CCR reforming unit. Feedstock is introduced via line 11 in CCR reforming unit 12. The effluent of reforming unit 12 is led via line 13 to separator 14. A hydrogen-rich gaseous stream is then separated from the effluent and partly recycled to reforming unit 12 via line 15. Further, the hydrocarbon stream is fed via line 16 to stabilizer 17. In stabilizer 17, the hydrocarbon stream is fractionated into fuel gas, a C4-hydrocarbons stream, and a C5+ reformate. The fuel gas is withdrawn via line 18, the C4-hydrocarbons stream via line 19. Reformate is sent to gasoline pool 21 via line 20.

Continuous catalyst regeneration (CCR) reformers operate efficiently by ensuring that spent catalyst coke is removed continuously and re-conditioned via coke burns in the regenerator followed by re-activation of platinum and promoter metals in the Chlorination and metal reduction zones. The use of the Chlorination zones for metals re-dispersion can only occur when air and organic chloride are introduced into the Chlorination zones during what is generally referred to as white burn as described previously in the background of invention section. When nitrogen is used in the Chlorination zones instead of air and coke burns are conducted only in the burn zones of regenerators, the metals on catalyst particles are agglomerated due to the hydrothermal conditions in the burn zone of the regenerators. This mode of incomplete activation of the spent catalyst involving only the coke burn and no platinum and promoter metals re-dispersion is referred to as black burn. During low octane naphtha operations in the reactors, low catalyst coke of less than 2.0 wt. % are produced and as such regenerator operations have to be discontinued and regenerators put on hold due to low spent catalyst coke. The regenerator outages are necessary due to unstable coke burns to protect equipment around the regenerator such as the air heater, the Disengaging Hopper and regenerator screens. Regenerators are sometimes used intermittently and this mode of operating the regenerators leads to poor reformer operations and low reformate and hydrogen yields due to some fraction of agglomerated catalyst particles in the reactor section. This invention permits generating sufficient catalyst coke in the reactors so as to permit steady state white burn operations of the regenerator and ensure continuous reactivation of the catalyst.

Current operations of CCR platformers or reformers are at low platformate octane severities due to increased ethanol blending in gasoline with up to 15% ethanol in the gasoline. CCR platformers that were designed to operate with highly paraffinic naphtha and at high reformate octane severities now operate at such low reformate octane severities that spent catalyst coke have dropped to less than 50% of the design coke production. As a consequence, regenerators designed to maintain optimal activity of reforming catalysts are often not used. Concerns with respect to unstable coke combustion in the regenerators and possible damage to equipment such as the air heater, disengaging hopper and regenerator screens lead to non use of the regenerators. Consequences of the regenerator outages and sporadic use of the regenerators are inactive catalyst, poor reformer productivity and profitability. In order to enhance reformer productivity during low reformate octane severity operations; we add a measured amount of sulfur combined with C11 to C16 hydrocarbons to permit maintaining sufficient catalyst coke for use of steady state white burn regenerator operations.

The amount of coke precursor compounds should be such as to produce spent catalyst carbon of about 3½ to 7 wt. % to ensure steady state white burn operation. For black burn operations the spent catalyst coke could be in the range of 7-20 wt. %. The invention therefore covers both black and white burn operations and is primarily aimed at sustaining white burn steady state operations to derive full benefits in CCR reforming process.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

We claim:

1. A process of operating a continuous catalyst regeneration (CCR) reforming system comprising the steps of:

introducing a C11-C20 hydrocarbon and sulfur mix for increased coke make into a hydrocarbon feedstock comprising naphtha;

continuously introducing the hydrocarbon feedstock and the C-11-C20 hydrocarbon and sulfur mix into a CCR reforming unit;

continuously introducing hydrogen into the CCR reforming unit;

continuously operating the CCR reforming unit to produce catalyst coke and a hydrocarbon rich hydrocarbon stream;

continuously operating the CCR reforming unit to burn off excessive catalyst coke; and continuously recovering the hydrocarbon rich hydrocarbon stream, wherein said mix is obtained by adding a measured amount of sulfur to said C11-C20 hydrocarbon, said amount sufficient to maintain steady state regenerator conditions.

2. The process of claim 1 further comprising the step of operating the CCR reforming unit to increase coke yield greater than 3 wt. %.

3. The process according to claim 1 further comprising the step of separating hydrogen from the recovered hydrocarbon stream.

4. The process according to claim 3 further comprising the step of feeding a portion of the hydrogen to the CCR reformer unit.

5. The process according to claim 1 further comprising the step of fractionating the recovered hydrocarbon stream into fuel gas, a C4 hydrocarbon stream and a C5+ reformate.

6. A process of operating a continuous catalyst regeneration (CCR) reforming system comprising the steps of:

introducing a C11-C14 hydrocarbon and sulfur mix for increased coke make into a hydrocarbon feedstock comprising naphtha;

continuously introducing the hydrocarbon feedstock and the C-11-C14 hydrocarbon and sulfur mix into a CCR reforming unit;

continuously introducing hydrogen into the CCR reforming unit;

continuously operating the CCR reforming unit to produce catalyst coke and a hydrocarbon rich hydrocarbon stream;

continuously operating the CCR reforming unit to burn off excessive catalyst coke; and continuously recovering the hydrocarbon rich hydrocarbon stream, wherein said mix is obtained by adding a measured amount of sulfur to said C11-C14 hydrocarbon, said amount sufficient to maintain steady state regenerator conditions.

7. A process of operating a continuous catalyst regeneration (CCR) reforming system comprising the steps of:

introducing a kerosene and sulfur mix for increased coke make into a hydrocarbon feedstock comprising naphtha;

continuously introducing the hydrocarbon feedstock and the kerosene and sulfur mix into a CCR reforming unit;

continuously introducing hydrogen into the CCR reforming unit;

continuously operating the CCR reforming unit to produce catalyst coke and a hydrocarbon rich hydrocarbon stream;

continuously operating the CCR reforming unit to burn off excessive catalyst coke; and continuously recovering the hydrocarbon rich hydrocarbon stream, wherein said mix is obtained by adding a measured amount of sulfur to said kerosene, said amount sufficient to maintain steady state regenerator conditions.

* * * * *